US011064731B2

(12) United States Patent
Fan et al.

(10) Patent No.: US 11,064,731 B2
(45) Date of Patent: Jul. 20, 2021

(54) ATOMIZER CAPABLE OF REFILLING TOBACCO LIQUID AND ELECTRONIC CIGARETTE HAVING SAME

(71) Applicant: Shenzhen First Union Technology Co., Ltd., Shenzhen (CN)

(72) Inventors: Fangqin Fan, Shenzhen (CN); Yonghai Li, Shenzhen (CN); Zhongli Xu, Shenzhen (CN); Yonglu Guo, Shenzhen (CN)

(73) Assignee: Shenzhen First Union Technology Co., Ltd., Guangdong (CN)

( * ) Notice: Subject to any disclaimer, the term of this patent is extended or adjusted under 35 U.S.C. 154(b) by 267 days.

(21) Appl. No.: 16/145,204

(22) Filed: Sep. 28, 2018

(65) Prior Publication Data

US 2019/0098932 A1 Apr. 4, 2019

(30) Foreign Application Priority Data

Sep. 30, 2017 (CN) ..... 201721278706.X

(51) Int. Cl.

| | |
|---|---|
| ***A24F 40/40*** | (2020.01) |
| ***A24F 40/485*** | (2020.01) |
| ***A24F 15/015*** | (2020.01) |
| ***A24F 40/10*** | (2020.01) |
| ***A24F 7/00*** | (2006.01) |

(52) U.S. Cl.

CPC ..... *A24F 7/00* (2013.01); *A24F 40/40* (2020.01); *A24F 40/485* (2020.01); *A24F 15/015* (2020.01); *A24F 40/10* (2020.01)

(58) Field of Classification Search

CPC ..... A24F 47/008; A24F 40/40

See application file for complete search history.

(56) References Cited

U.S. PATENT DOCUMENTS

2016/0219935 A1 8/2016 Qiu

FOREIGN PATENT DOCUMENTS

| | | | |
|---|---|---|---|
| CN | 205 695 707 | U | 11/2016 |
| CN | 205 813 571 | U | 12/2016 |
| CN | 106 686 996 | A | 5/2017 |
| WO | 2017/024926 | A1 | 2/2017 |
| WO | 2018/113195 | A1 | 6/2018 |

*Primary Examiner* — Eric Yaary

*Assistant Examiner* — Jennifer A Kessie

(74) *Attorney, Agent, or Firm* — Proi Intellectual Property US; Klaus Michael Schmid

(57) ABSTRACT

An atomizer capable of refilling tobacco liquid and an electronic cigarette having the same are disclosed, including: an atomizing body with a liquid storage chamber formed therein; the atomizing body has an injection end for injecting tobacco liquid, the injection end of the atomizing body has a liquid inlet communicated with the liquid storage chamber; an end cover, movably arranged on the end of the atomizing body and capable of reversibly moving from a first place to a second place, when the end cover is at the first place, the liquid inlet is closed, when the end cover is at the second place, the liquid inlet is opened; and an elastic element, configured to supply an elastic deforming force on the end cover opposite to a moving direction of the end cover, during that the end cover is moving from the first place to the second place.

14 Claims, 6 Drawing Sheets

ATOMIZER CAPABLE OF REFILLING TOBACCO LIQUID AND ELECTRONIC CIGARETTE HAVING SAME

TECHNICAL FIELD

The present disclosure relates to the field of smoking sets, and particularly, to an atomizer capable of refilling tobacco liquid and an electronic cigarette having same.

BACKGROUND ART

Currently, an atomizer capable of refilling tobacco liquid generally uses methods for unscrewing an end cover via a thread screw or a fastener, causing a liquid storage component at a lower position, as well as a main part of the atomizer to depart from the end cover. For example, as shown in FIG. 1, the prior art discloses an atomizer, including an end cover 10 with a mouthpiece 30 at an upper position, and a liquid storage component 20 at a lower position, the top end of the liquid storage component 20 has an liquid inlet 40, the end cover 10 is configured for opening or closing the liquid inlet 40, the upper end of the liquid storage component 20 has a fastener 50, the end cover 10 is screwed on the liquid storage component 20 via the fastener 50 or unscrewed on the liquid storage component 20. However, in the process of refilling the tobacco liquid into the atomizer in this structure, the end cover 10 at the upper position needs to be detached from the atomizer, which has a complex operation process. And the detached end cover 10 is easy to get lost and forgotten, the mouthpiece 20 on the end cover 10 is easy to be contaminated by extraneous matters.

SUMMARY

In view of the drawbacks in the prior art, the present disclosure relates to an atomizer of an electronic cigarette capable of refilling tobacco liquid, with an easy refilling operation and that the end cover doesn't get lost easily.

To solve the above technical problems, an atomizer capable of refilling tobacco liquid is disclosed including an atomizing body with a liquid storage chamber formed therein; the atomizing body has an injection end for injecting tobacco liquid, the injection end of the atomizing body has a liquid inlet communicated with the liquid storage chamber; an end cover, movably arranged on an end of the atomizing body and capable of reversibly moving from a first place to a second place, when the end cover is at the first place, the liquid inlet is closed, when the end cover is at the second place, the liquid inlet is opened; and an elastic element, configured to supply an elastic force on the end cover opposite to a moving direction of the end cover, during that the end cover is moving from the first place to the second place.

Preferably, the end cover includes a sealing strip movably sliding between the first place and the second place, the sealing strip is configured for sealing or opening the liquid inlet.

Further, the sealing strip includes a first groove, matched with a limiting pole that is carried on the injection end of the atomizing body; the limiting pole is configured for limiting moving of the sealing strip from the first place to the second place.

According to an embodiment of the present disclosure, the elastic element is a W-shaped spring; two ends of the W-shaped spring are fixed on the injection end of the atomizing body so that a deforming force is applied to the sealing strip.

More specifically, the injection end of the atomizing body has two positioning poles for connecting the W-shaped spring, a middle part of the W-shaped spring is clamped with a connecting pole of the sealing strip, in this case, the connecting pole deviates from a line connecting the two positioning poles.

Further, the sealing strip has a second groove for accommodating the positioning poles to slide along, a width of the second groove is matched with an outer diameter of the positioning pole.

Further, the injection end has an elastic sealing plate, protruding along edge of the liquid inlet to form a convex ring part.

Further, the end cover includes a mouthpiece for allowing users to inhale an aerosol.

Further, a center of the injection end has an air outlet, a center of the sealing strip has a through hole for communicating with the air outlet and an air hole within the mouthpiece.

An electronic cigarette is further disclosed by the present disclosure, including the aforementioned atomizer capable of refilling tobacco liquid and a power supply for electrically connecting with the atomizer.

Additional aspects and advantages of the present disclosure will be: the end cover and the atomizing body are integrally connected, when users don't need to detach the end cover during injection of tobacco liquid, only need to push the end cover horizontally to open the liquid inlet, which may realize injection of tobacco liquid and simplify the injection operation. Moreover, the above elastic element is configured to supply an elastic force on the end cover opposite to a moving direction of the end cover, during that the end cover is moving from the first place to the second place, which may avoid that the end cover is opened by malfunctions to leak the tobacco liquid. Moreover, the end cover stays at the first place or the second place without the external force to ensure smooth injection of the tobacco liquid.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
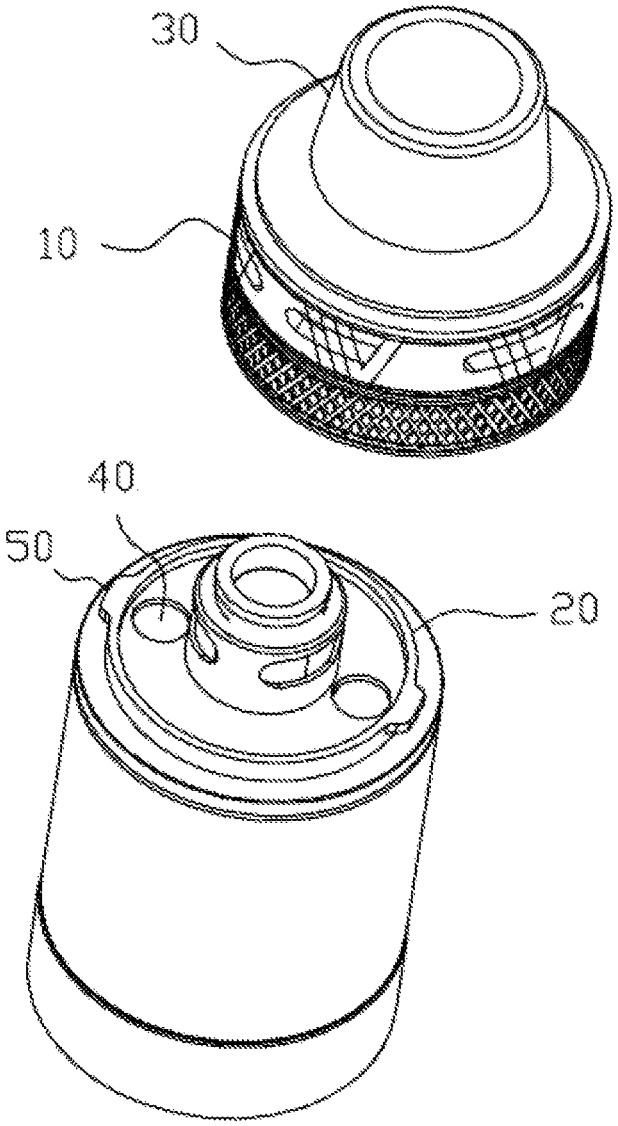
FIG. 1 is an isometric view of an atomizer capable of refilling tobacco liquid in the prior art.
Figure 2:
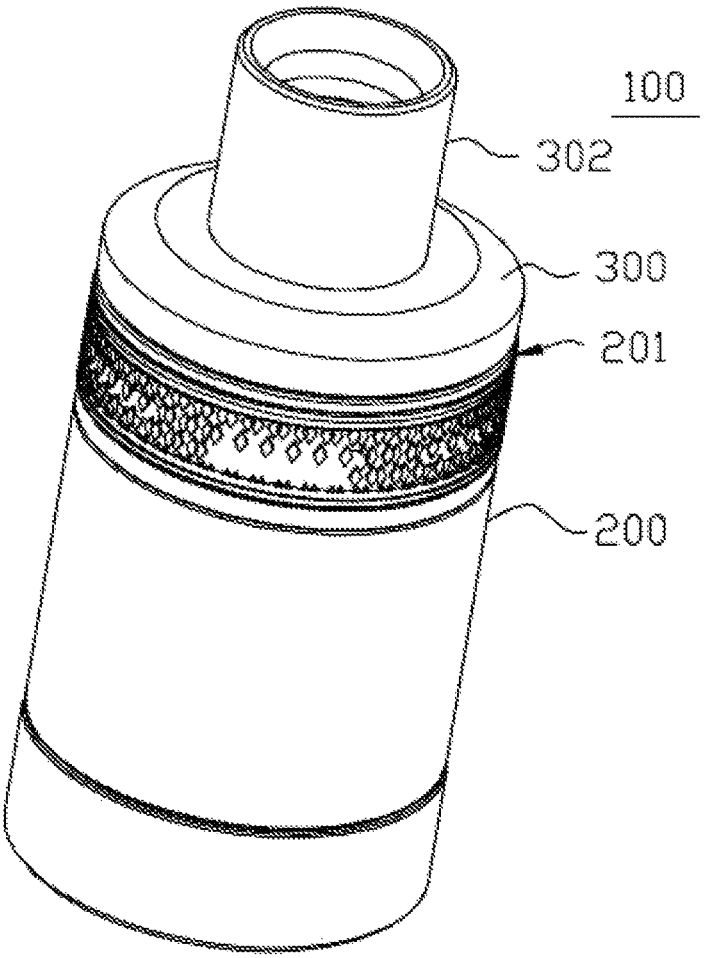
FIG. 2 is an aspect view of the atomizer capable of refilling tobacco liquid when the liquid inlet is closed in accordance with an embodiment of the present disclosure.
Figure 3:
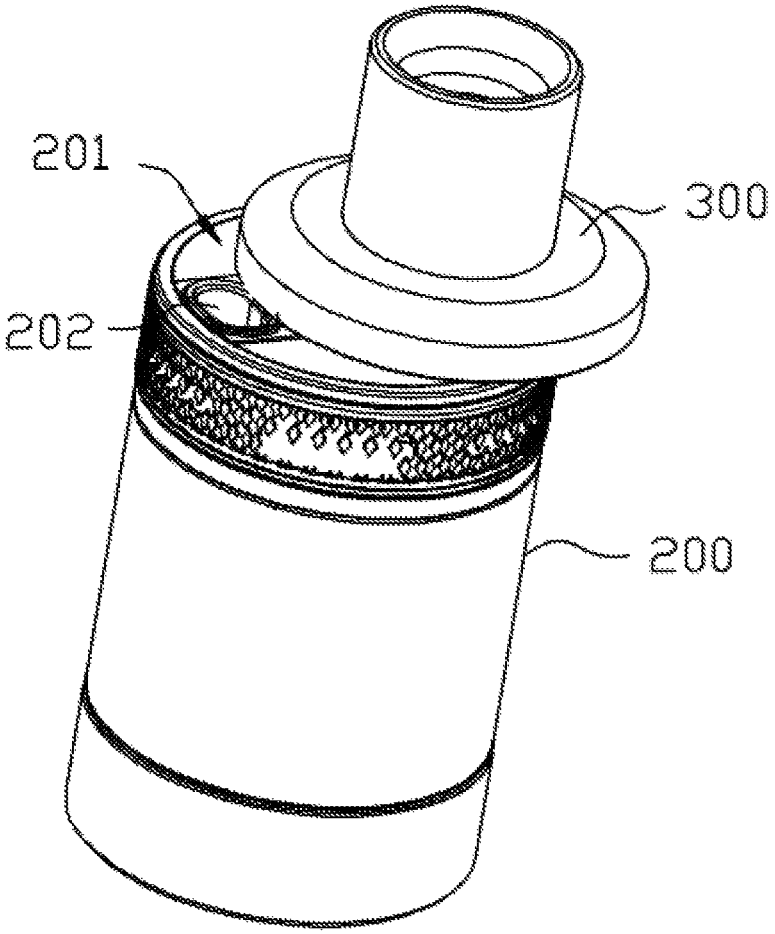
FIG. 3 is an aspect view of the atomizer capable of refilling tobacco liquid when the liquid inlet is opened in accordance with an embodiment of the present disclosure.

Referring to FIG. 2 and FIG. 3, the present disclosure relates to an atomizer 100 capable of refilling tobacco liquid. The atomizer 100 includes an atomizing body 200 and an end cover 300 above the atomizing body 200. A liquid storage chamber (not shown) is formed inside the atomizing body 200. The atomizing body 200 includes an injection end 201. The injection end 201 of the atomizing body 200 has a liquid inlet 202 communicated with the liquid storage chamber. An end cover 300, movably arranged on the injection end 201 of the atomizing body 200 and capable of reversibly moving from a first place to a second place, as shown in FIG. 2, when the end cover 300 is at the first place, the liquid inlet 202 is closed, when the end cover 300 is at the second place, the liquid inlet 202 is opened, in this case, users may proceed injection operation, therefore, the users only need to push the end cover 300 horizontally without detaching the end cover 300, which avoids the end cover 300 getting lost and has a more convenient injection operation.

According to a first aspect of the present invention, the above end cover 300 further includes a mouthpiece 302 for users inhaling, the mouthpiece 302 is disposed at a center of the end cover 300, moving along with the moving of the main part of the end cover 300. Understandable, the mouthpiece 302 is not in correlation with the main part of the end cover 300, for example, the main part of the end cover 300 may be moving horizontally or rotated from the first place to the second place, so as to open or close the liquid inlet 202.

Figure 4:
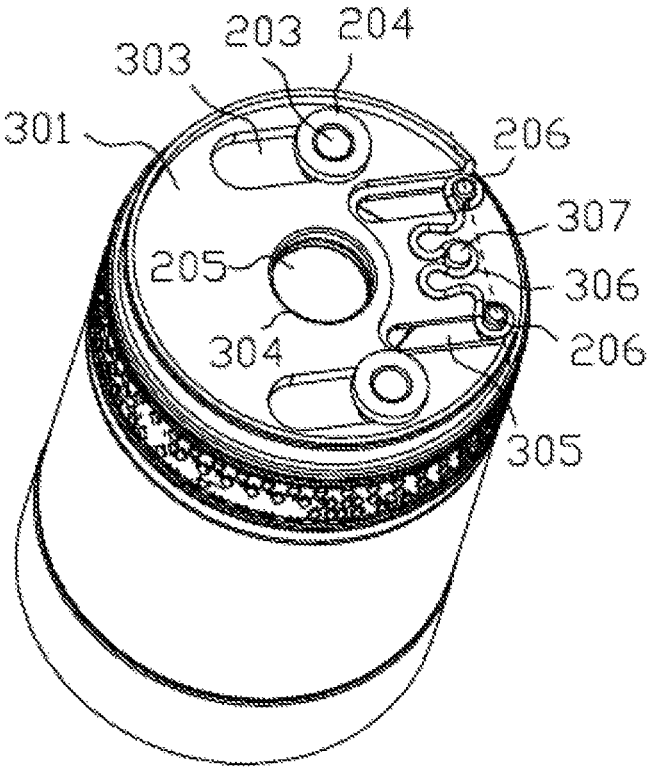
FIG. 4 is an aspect view of the sealing strip at a first place in accordance with an embodiment of the present disclosure.

The atomizer 100 capable of refilling tobacco liquid further includes an elastic element applying an elastic force between the end cover 300 and the atomizing body 200, configured to supply an elastic force on the end cover 300 opposite to a moving direction of the end cover 300, during that the end cover 300 is moving from the first place to the second place. The specific structure of the elastic element is described hereinafter:

With reference to FIG. 4, the end cover 300 includes a sealing strip 301 movably sliding between the first place and the second place along a linear trajectory. The above mouthpiece 302 is connected with the sealing strip 301. The sealing strip 301 may be sliding along a surface of the injection end 201, configured for sealing or opening the liquid inlet 202. Understandable, in terms of moving trajectory of the sealing strip 301, it may be realized by rotationally sliding along with a curve line or longitudinally sliding along with a linear trajectory to expose the liquid inlet 202.

In order to carry the sealing strip 301 on the injection end 201, the sealing strip 301 includes a first groove 303 matched with a limiting pole 203 that is carried on the injection end 201 of the atomizing body 200; the limiting pole 203 is configured for limiting the moving of the sealing strip 301 from the first place to the second place. Two first grooves 303 as a preference in the present disclosure are corresponding to two limiting poles 203, to avoid deviation of the end cover 300. The limiting poles 203 pass through the first grooves 303 on the sealing strip 301 to be connected with two caps 204, which avoids the end cover 300 to depart from the injection end 201.

According to a second aspect of the present disclosure, the elastic element is a W-shaped spring 306, two ends of the W-shaped spring 306 are fixed on the injection end 201. The W-shaped spring 306 applies an elastic force to the sealing strip 301.

More specifically, the injection end 201 of the atomizing body 200 has two positioning poles 206 for connecting the W-shaped spring 306, a middle part of the W-shaped spring 306 is clamped with a connecting pole 307 of the sealing strip 301, in this case, the connecting pole 307 deviates from a line connecting the two positioning poles 206. Further, to realize the above structure, the sealing strip 301 has a second groove 305 for accommodating the positioning poles 206 to slide along, of which, two second grooves 305 are a preference for the present disclosure, nearly parallel with the first grooves 303; a width of the second groove 305 is matched with an outer diameter of the positioning pole 206, avoiding deviation of the sealing strip 301.

With reference to FIG. 4, when the sealing strip 301 is at the first place, the limiting pole 203 is within a right part of the first groove 303, and the connecting pole 307 is at left side of the line connecting the two positioning poles 206, in this case, the sealing strip 301 entirely cove the above liquid inlet 201. If an external right force is applied to push the sealing strip 301, the W-shaped spring 306 generates a left elastic force to prevent the moving of the sealing strip 301, so that the sealing strip 301 remains at the first place, avoiding the end cover 300 to be opened by children or mal-operation.

Meanwhile, a center of the injection end 201 has an air outlet 205, a center of the sealing strip 301 has a through hole 304 for communicating with the air outlet 205 and an air hole 304 within the mouthpiece 302. When the sealing strip 301 is at the first place, the air hole 304 is overlapped with the air outlet 205, which is beneficial for users to inhale.

Figure 5:
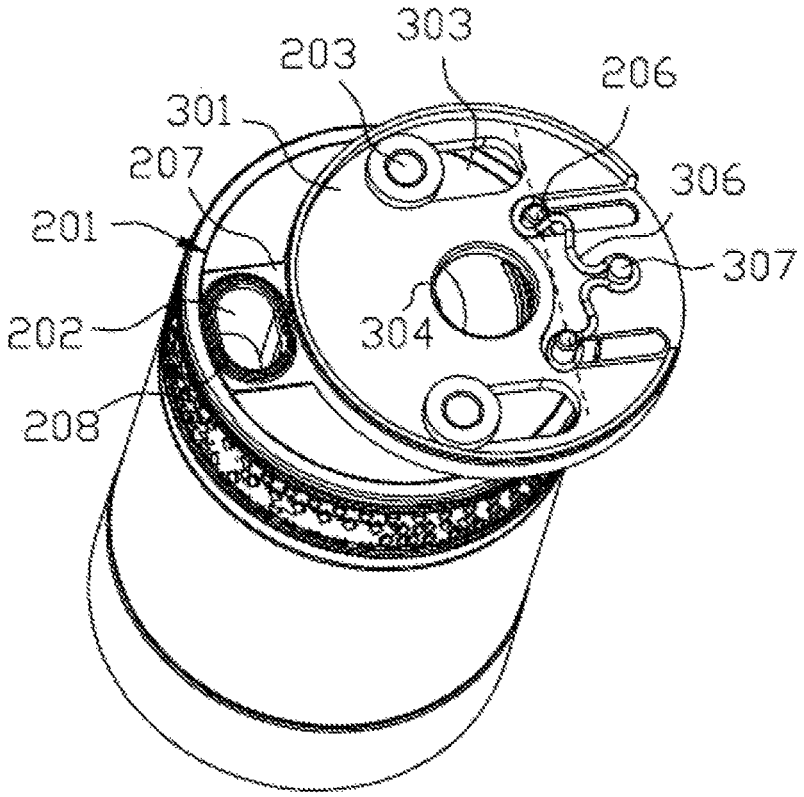
FIG. 5 is an aspect view of the sealing strip at a second place in accordance with an embodiment of the present disclosure.

With reference to FIG. 5, when the sealing strip 301 is pushed to the second place by the user, the limiting pole 203 is moving to the left side of the second groove 303, then the liquid inlet 201 is exposed. In this case, the connecting pole 307 is at the right side of the line connecting two positioning poles 206. When a left external force is applied to the sealing strip 301, the W-shaped spring 306 generates a right elastic force to prevent the moving of the sealing strip 301, ensuring the sealing strip 301 remaining at the second place, which is beneficial for users to fulfill the operation of refilling tobacco liquid.

According to a third aspect of the present disclosure, the injection end 201 has an elastic sealing plate 207, the elastic sealing plate 207 is aligned with an end surface of the injection end 201. The elastic sealing plate 207 is protruding along edge of the liquid inlet to form a convex ring part 208. The ring part 208 tightly contacts a lower end surface of the sealing strip 301, improving the leak-tightness of the end cover 300.

Figure 6:
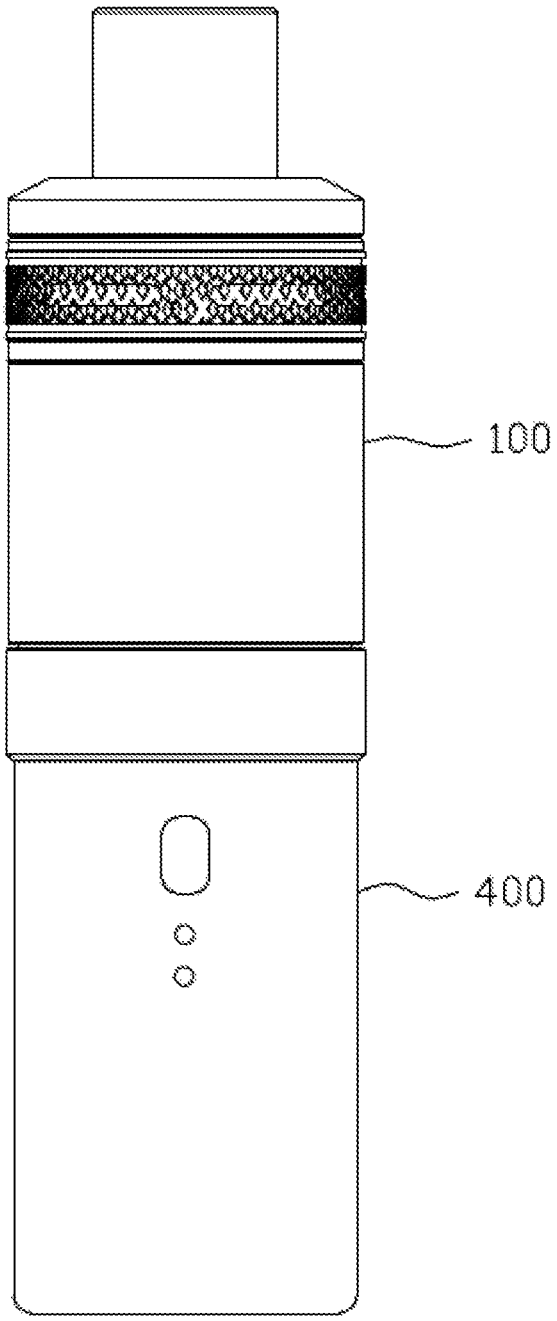
FIG. 6 is a front aspect view of the electronic cigarette in accordance with an embodiment of the present disclosure.

With reference to FIG. 6, the present disclosure further refers to an electronic cigarette, including the aforementioned atomizer 100 capable of refilling tobacco liquid and a power supply 400 for electrically connecting with the atomizer 100 and configured for supplying power to the atomizer 100.

Terminology used herein is for the purpose of describing particular embodiments only and is not intended to be limiting of the invention. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer capable of refilling tobacco liquid comprising:

an atomizing body with a liquid storage chamber formed therein; the atomizing body has an injection end for injecting tobacco liquid, the injection end of the atomizing body has a liquid inlet communicated with the liquid storage chamber;

an end cover, movably arranged on an end of the atomizing body and capable of reversibly moving from a first place to a second place, when the end cover is at the first place, the liquid inlet is closed, when the end cover is at the second place, the liquid inlet is opened; and an elastic element, configured to supply an elastic force on the end cover opposite to a moving direction of the end cover, during that the end cover is moving from the first place to the second place;

wherein the end cover comprises a sealing strip movably sliding between the first place and the second place along a linear trajectory, the sealing strip is configured for sealing or opening the liquid inlet, and the linear trajectory is perpendicular to an axial direction of the atomizer;

wherein the elastic element is a W-shaped spring; two ends of the W-shaped spring are fixed on the injection end of the atomizing body so that a deforming force is applied to the sealing strip.

2. The atomizer according to claim 1, wherein the sealing strip comprises a first groove, matched with a limiting pole that is carried on the injection end of the atomizing body; the limiting pole is configured for limiting moving of the sealing strip from the first place to the second place.

3. The atomizer according to claim 1, wherein the injection end of the atomizing body has two positioning poles for connecting the W-shaped spring, a middle part of the W-shaped spring is clamped with a connecting pole of the sealing strip, the connecting pole deviates from a line connecting the two positioning poles.

4. The atomizer according to claim 1, wherein the sealing strip comprises a second groove for accommodating the positioning poles to slide along, a width of the second groove is matched with an outer diameter of the positioning pole.

5. The atomizer according to claim 1, wherein the injection end comprises an elastic sealing plate, protruding along edge of the liquid inlet to form a convex ring part.

6. The atomizer according to claim 1, wherein the end cover comprises a mouthpiece for allowing users to inhale an aerosol.

7. The atomizer according to claim 1, wherein a center of the injection end comprises an air outlet, a center of the sealing strip comprises a through hole for communicating with the air outlet and an air hole within the mouthpiece.

8. An electronic cigarette comprising:

an atomizer capable of refilling tobacco liquid comprising:

an atomizing body with a liquid storage chamber formed therein; the atomizing body has an injection end for injecting tobacco liquid, the injection end of the atomizing body has a liquid inlet communicated with the liquid storage chamber;

an end cover, movably arranged on the end of the atomizing body and capable of reversibly moving from a first place to a second place, when the end cover is at the first place, the liquid inlet is closed, when the end cover is at the second place, the liquid inlet is opened; and an elastic element, configured to supply an elastic force on the end cover opposite to a moving direction of the end cover, during that the end cover is moving from the first place to the second place;

a power supply for electrically connecting with the atomizer;

wherein the end cover comprises a sealing strip movably sliding between the first place and the second place along a linear trajectory, the sealing strip is configured for sealing or opening the liquid inlet, and the linear trajectory is perpendicular to an axial direction of the atomizer;

wherein the elastic element is a W-shaped spring; two ends of the W-shaped spring are fixed on the injection end of the atomizing body so that a deforming force is applied to the sealing strip.

9. The electronic cigarette according to claim 8, wherein the sealing strip comprises a first groove, matched with a limiting pole that is carried on the injection end of the atomizing body; the limiting pole is configured for limiting moving of the sealing strip from the first place to the second place.

10. The electronic cigarette according to claim 8, wherein the injection end of the atomizing body has two positioning poles for connecting the W-shaped spring, a middle part of the W-shaped spring is clamped with a connecting pole of the sealing strip, the connecting pole deviates from a line connecting the two positioning poles.

11. The electronic cigarette according to claim 8, wherein the sealing strip comprises a second groove for accommodating the positioning poles to slide along, a width of the second groove is matched with an outer diameter of the positioning pole.

12. The electronic cigarette according to claim 8, wherein the injection end comprises an elastic sealing plate, protruding along edge of the liquid inlet to form a convex ring part.

13. The electronic cigarette according to claim 8, wherein the end cover comprises a mouthpiece for allowing users to inhale an aerosol.

14. The electronic cigarette according to claim 8, wherein a center of the injection end comprises an air outlet, a center of the sealing strip comprises a through hole for communicating with the air outlet and an air hole within the mouthpiece.

* * * * *